US006092240A

United States Patent [19]

Weller

[11] Patent Number: 6,092,240

[45] Date of Patent: Jul. 25, 2000

[54] HORIZONTALLY OPEN RECTANGLE

[76] Inventor: Jean Dorothy Weller, 1530 Grand St., Alameda, Calif. 94501

[21] Appl. No.: 09/197,555

[22] Filed: Nov. 23, 1998

[51] Int. Cl.[7] ..... A41B 9/00; A41D 10/00; A41D 1/06; A41D 13/02; A41D 9/00

[52] U.S. Cl. ..... 2/238; 2/114; 2/228

[58] Field of Search ..... 2/114, 400, 403, 2/404, 405, 406, 407, 228, 238

[56] References Cited

U.S. PATENT DOCUMENTS

| | | | |
|---|---|---|---|
| 2,472,286 | 6/1949 | Drasnin . | |
| 2,671,903 | 3/1954 | Breul . | |
| 4,446,573 | 5/1984 | Green | 2/252 |
| 4,446,575 | 5/1984 | Davis | 2/400 |
| 4,533,355 | 8/1985 | Fair | 604/345 |
| 4,698,848 | 10/1987 | Buckley | 2/114 |
| 4,709,419 | 12/1987 | Heyn et al. | 2/46 |
| 4,888,006 | 12/1989 | Beaupied | 604/345 |
| 4,930,161 | 6/1990 | Cohen | 2/114 |
| 4,995,116 | 2/1991 | Beauchamp et al. | 2/104 |
| 5,067,178 | 11/1991 | Katchka | 2/250 |
| 5,093,935 | 3/1992 | Countee, Jr. | 2/400 |
| 5,138,715 | 8/1992 | Baustin | 2/96 |
| 5,142,702 | 9/1992 | Piloian | 2/102 |
| 5,172,430 | 12/1992 | Lerma-Solis | 2/400 |
| 5,228,140 | 7/1993 | Baustin | 2/93 |
| 5,375,265 | 12/1994 | Selzer | 2/242 |
| 5,669,078 | 9/1997 | Scremin et al. | 2/247 |
| 5,708,978 | 1/1998 | Johnsrud | 2/102 |
| 5,991,923 | 11/1999 | Maria | 2/83 |

*Primary Examiner*—Bibhu Mohanty
*Assistant Examiner*—Shirra L. Jenkins

[57] ABSTRACT

A pair of boxer shorts for use by individuals having an ostomy bag. The boxer shorts include a pair of leg openings, a front panel, a rear panel, a waistband and a horizontal opening which is just below and parallel to the waistband and to one side of the fly for allowing passage of an ostomy bag through the opening for easy access and additional comfort for the wearer.

1 Claim, 1 Drawing Sheet

HORIZONTALLY OPEN RECTANGLE

BACKGROUND OF THE INVENTION

For individuals who must use an ostomy bag, it is often both inconvenient and embarrassing to remove underwear in order to empty the ostomy bag. In addition, often the ostomy bag appliance will stick to the wearer's skin due to the warmth of the body. As such, there is a need for a garment which would prevent the inconvenience, embarrassment and discomfort of using an ostomy bag.

SUMMARY OF THE INVENTION

In view of the foregoing disadvantages, the present invention provides a pair of boxer shorts with a horizontal opening just below the waistband of the shorts. Further, there are no pockets or flaps to cover the ostomy bag once it is passed through the opening on the shorts thus alleviating the need for the wearer to disengage the bag from such structures making access to the bag easier.

BRIEF DESCRIPTION OF THE INVENTION

DETAILED DESCRIPTION OF THE DRAWINGS

Figure 1:
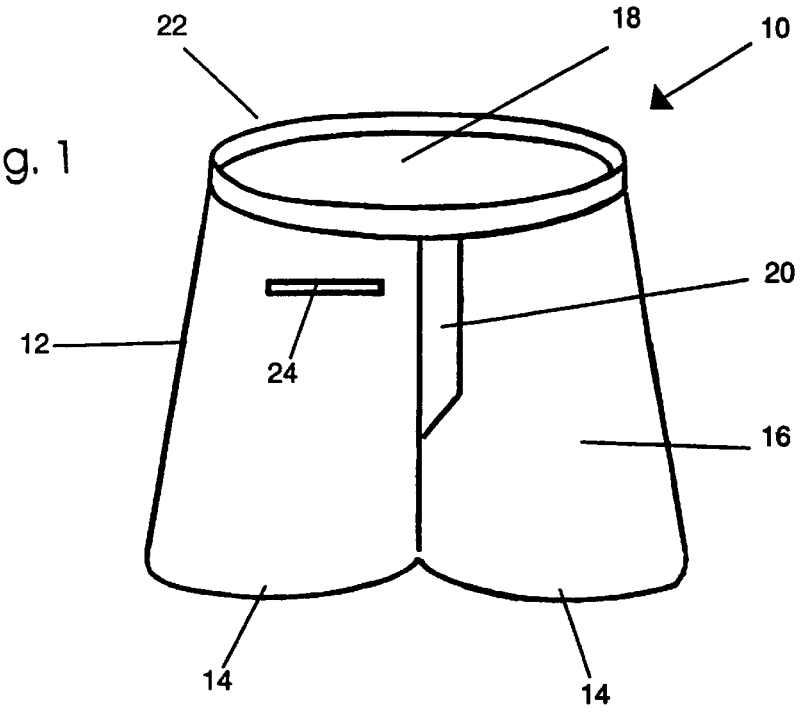
FIG. 1 shows a front perspective view of the boxer shorts with the horizontal opening.
Figure 2:
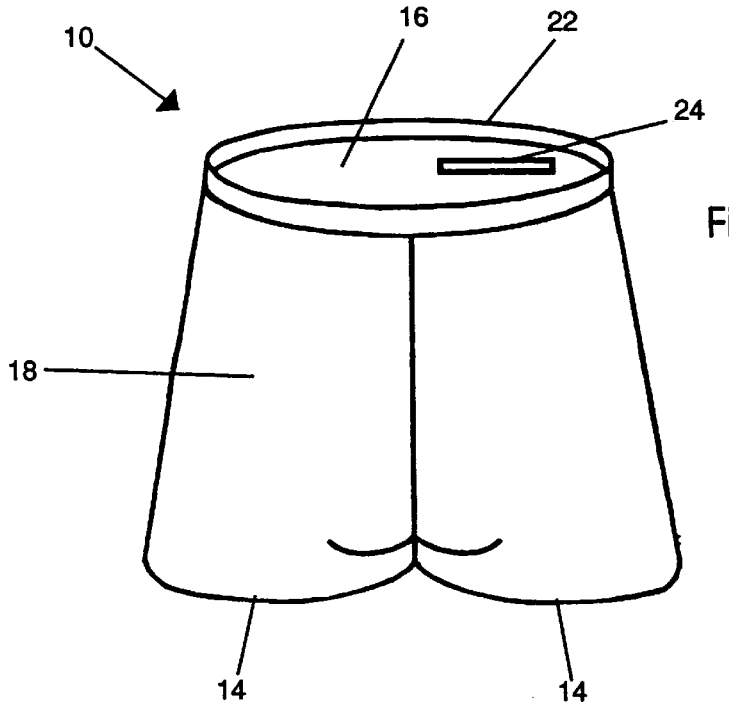
FIG. 2 shows a rear perspective view of the boxer shorts with the horizontal opening.

With reference to the drawings, FIG. 1 shows the invention 10 which includes a pair of boxer shorts 12. The boxer shorts are of conventional construction with a pair of leg openings 14, a front panel 16, a rear panel 18, a waistband 22, and a fly 20 which is located at the center of the garment on the front panel 16. However, as seen from the figures, the shorts 12 includes a horizontal opening 24 for passing an ostomy bag through. The opening 24 is positioned on the front panel 16 of the shorts 12 just below the waist band 22 and to one side of the fly 20. This location allows the wearer to easily access the opening 24 and thus the ostomy bag for readily emptying the bag. In addition, this location prevents the ostomy bag from sticking to the warm skin of the wearer. By placing the ostomy bag through the opening 24 this allows the fabric of the shorts 12 to act as a barrier between the bag and the wearer's skin. It should also be noted that there are no pockets or flaps which could inhibit access to the ostomy bag and be uncomfortable.

The structure of the invention 10 allows the wearer the convenience of emptying an ostomy bag without having to remove the boxer shorts 12 thus preventing the wearer the embarrassment of removing the boxer shorts. Also, the location of the opening 24 which is on the front panel just below the waistband and just to the side of the fly allows the ostomy bag to be easily accessed. Finally, the direction of the opening, which is in an horizontal plan and parallel to the waistband, allows the ostomy bag to hang freely thus providing the wearer with a more comfortable means of holding the bag in a desired location.

What is claimed is:

1. A pair of boxer shorts comprising:

a pair of leg openings, a front panel, a rear panel, a waistband and a fly located at the center of the front panel and further including an horizontal opening which is located just below and parallel to the waistband and to one side of the fly on the front panel where the horizontal opening is sized to accommodate the passage of an ostomy bag therethrough, wherein the opening is unattached or unencumbered by pockets or flaps associated therewith.

* * * * *